United States Patent [19]

Pietsch

[11] 4,079,345

[45] Mar. 14, 1978

[54] MULTI-POLE EXCESS CURRENT CIRCUIT BREAKER

[75] Inventor: Erhard Pietsch, Winkelhaid, Germany

[73] Assignee: Ellenberger & Poensgen GmbH, Altdorf, Germany

[21] Appl. No.: 694,223

[22] Filed: Jun. 9, 1976

[30] Foreign Application Priority Data

Aug. 6, 1975 Germany ..... 2535109

[51] Int. Cl.[2] ..... H01H 73/50

[52] U.S. Cl. ..... 335/10; 337/48

[58] Field of Search ..... 200/153 V; 335/8, 9, 335/10; 337/45, 46, 47, 48, 49, 50

[56] References Cited

U.S. PATENT DOCUMENTS

| | | | |
|---|---|---|---|
| 2,304,253 | 12/1942 | Healis | 335/10 |
| 3,530,412 | 9/1970 | Gryctko | 335/8 |
| 3,760,308 | 9/1973 | Misencik et al. | 337/46 X |

FOREIGN PATENT DOCUMENTS 2,132,738 7/1972 Germany.

*Primary Examiner*—A. D. Pellinen
*Attorney, Agent, or Firm*—Spencer & Kaye

[57] ABSTRACT

A multi-pole excess current circuit breaker assembly has a plurality of single-pole circuit breakers. In each of the latter the electric contacts are openable by a spring-loaded tripping mechanism actuated by a release lever as the release lever is moved from a first position to a second position by an excess current responsive device. The actuated tripping mechanism moves the release lever from the second position to a third position. The release levers of all the single-pole circuit breakers are operatively interconnected by a one-piece coupling member which is fixedly attached to one of the release levers, but is coupled to the others with a clearance, so that when excess current flows through the contacts of one of the single-pole circuit breakers, the release lever of the latter will move the release levers of the other single-pole circuit breakers only when it is displaced from the second position to the third position by the tripping mechanism of that single-pole circuit breaker through which the excess current flows.

5 Claims, 4 Drawing Figures

MULTI-POLE EXCESS CURRENT CIRCUIT BREAKER

Figure 1:
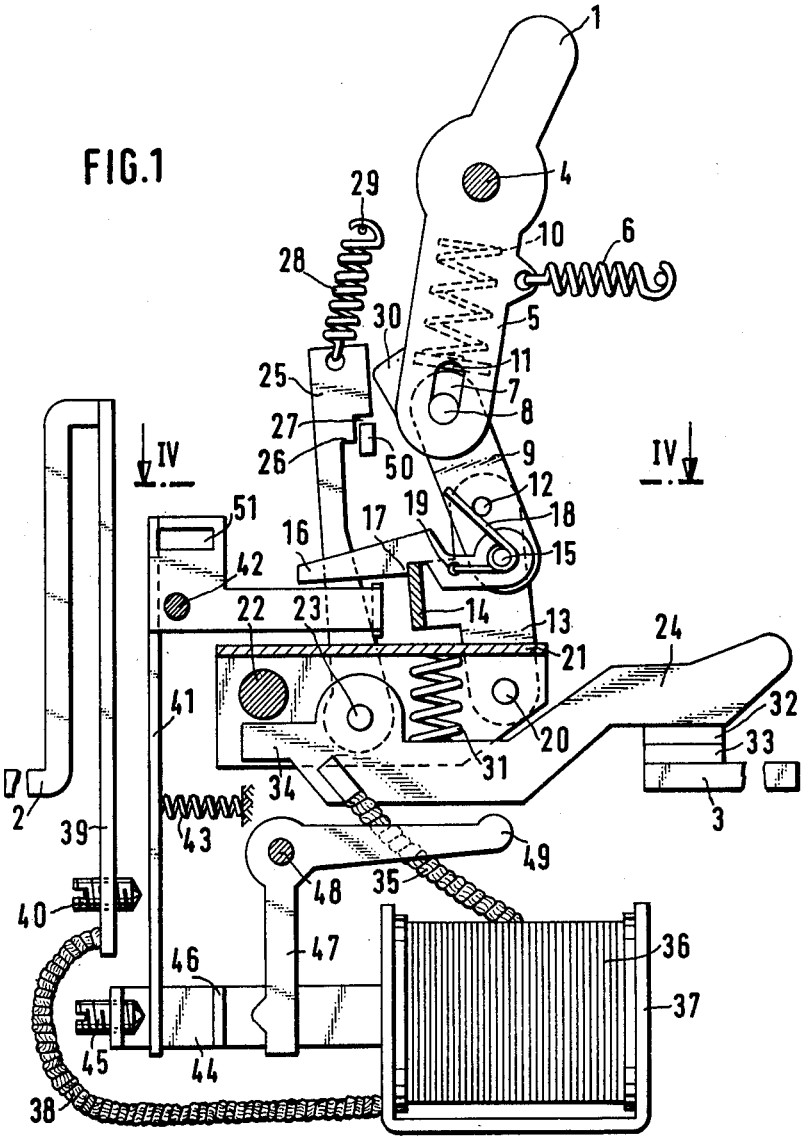

The present invention relates to a multi-pole excess current circuit breaker.

German Pat. No. 2,132,738 relates to a multi-pole excess current circuit breaker consisting of as many single-pole excess current circuit breakers as there are poles. Each single excess current circuit breaker includes a thermal and/or electromagnetic trip, a casing, and an actuating element which is pivoted in the casing and designed as a rocking lever with two arms. The actuating element is connected to a contact support, pivotally mounted in the casing by means of a toggle linkage comprising two levers. An arm of the actuating element disposed in the casing is connected to one of the two levers of the toggle linkage by means of a pin and slot connection. A spring is provided in the arm, the spring tends to press this lever of the toggle linkage away from the arm of the actuating element. A locking lever is pivotally mounted on said one toggle lever. The locking lever locks the toggle in an almost straight position by the locking lever being engaged, under the action of a further spring, with a projection formed on the other of the two toggle levers. The locking lever can be pivoted into an inactive position by a further lever which is actuatable by the thermal and/or electromagnetic trip. A retaining latch is pivotally mounted on the contact support, which latch has a retaining lug which can, during the switching-on movement, be engaged, shortly before reaching the on-position, with a stop fixed to the casing against the force of a spring. The retaining lug can subsequently be disengaged from the stop by the arm of the actuating element disposed inside the casing. In this multi-pole excess current circuit breaker, both the circuit breaker casings and the switching drives of all the single-pole excess current circuit breakers are mechanically connected to one another. For conjoint tripping, in particular for trip-free release, the trips of all the single-pole excess current circuit breakers must be mechanically connected to form a conjoint tripping unit. Depending on the number of the single-pole excess current circuit breakers coupled to one another, the conjoint tripping unit requires a correspondingly multiplied tripping force which, in the case of an excess current on one pole, must be provided by one single trip. As a consequence, for example, the bimetallic strip of the thermal trip must do substantially more mechanical work, which prolongs the tripping time. This circumstance manifests itself in a particularly disadvantageous way in the case of low current intensities with a low heating power and in the case of thin bimetalic strips.

According to the present invention there is provided a multi-pole excess current circuit breaker comprising two or more single-pole excess current circuit breakers, each single pole circuit breaker including a casing, an excess current trip, an actuating element pivotally mounted in the casing and having one arm disposed in the casing and another arm actuable from outside the casing, a fixed contact, a movable contact, a pivotally mounted contact support to which the movable contact is secured, a toggle linkage comprising first and second pivotally connected levers coupling the one arm of the actuating element to the contact support, the first lever being engageable in a slot in said one arm, a first spring for biasing the first lever away from said one arm, a locking lever pivotally mounted on the first lever, the locking lever being adapted to lock the toggle linkage in an almost straight position by engaging, under the action of a second spring, a projection provided on the second lever, and a further lever actuatable by the excess current trip for pivoting, under the influence of a third spring, the locking lever into an inactive position, a coupling member operatively coupling the further levers of the single pole circuit breakers together, the coupling member being secured to one of the further levers and forming a lost motion coupling with the other further lever or levers, whereby when the excess current trip of one of the single pole circuit breakers is tripped, its further lever is displaced pivoting the locking lever to its inactive position and allowing the contact support to pivot away from the fixed contact under the influence of the third spring and to engage the further lever displacing further, once the further lever has moved through a predetermined distance, the coupling member actuates the other further lever(s) causing tripping of the other single pole circuit breaker or the remainder of the single pole circuit breakers.

In a multi-pole excess current circuit breaker in accordance with the invention when an excess current occurs in only one single-pole excess current circuit breaker, the force which must be applied in order to trip all the single-pole excess current circuit breakers is only that which is required to trip this single-pole excess current circuit breaker.

In one embodiment of the present invention a coupling member is rigidly joined to the further lever of one of the single-pole circuit breakers and can be operatively coupled to the remaining single-pole circuit breakers only after a preset clearance has been overcome. With this arrangement when an excess current occurs in one of the single-pole circuit breakers, only this circuit breaker can be tripped, because of the preset clearance, and the remaining single-pole circuit breakers are tripped subsequently by the contact support which is under the action of the third spring in tension, of the tripping single-pole circuit breaker via the coupling member and the other further lever(s).

More particularly when an excess current occurs in one single-pole excess current circuit breaker, the corresponding further lever is pivoted by a thermal and/or electromagnetic tripping of this single-pole excess current circuit breaker and in turn puts the locking lever into its inactive position so that the toggle linkage folds in and the third spring in tension lifts the contact support, as a result of which the switch contacts are separated and, at the same time, the appropriate further lever with the coupling member is pivoted by the contact support so that the other further lever(s) of the remaining single-pole excess current circuit breaker(s) is or are also pivoted by the coupling member and hence these remaining single-pole excess current circuit breakers are tripped. Thus, the force for tripping the remaining single-pole excess current circuit breaker(s) is supplied by the third spring in tension, which acts on the contact support of the tripping single-pole excess current circuit breaker.

Each lever may have a rectangular recess and the coupling member consisting of insulating material is rigidly fixed, by means of a screw, in the rectangular recess of the lever of one of the single-pole excess current circuit breakers. One offset part of the coupling member which has a rectangular cross-section engages, leaving a clearance, with each of the corresponding recesses in the levers of the remaining single-pole excess current circuit breakers.

Each further lever has an arm which, in the on-position, lies parallel to the corresponding contact support and between this contact support and the locking lever so that, when one single-pole excess current circuit breaker is tripped, the contact support pivots the arm and hence the further lever which in turn, by this pivoting, causes the locking lever to be pivoted, as a result of which the tripping of the single-pole excess current circuit breaker is initiated. Almost simultaneously, the further levers of the remaining excess current circuit breakers are also pivoted by means of the coupling member and the tripping of these remaining single-pole excess current circuit breakers is thus initiated. In this way, all the single-pole excess current circuit breakers are tripped virtually simultaneously.

The individual shafts of the levers of the single-pole excess current circuit breaker are preferably connected to one another in mutual alignment by the coupling member.

Figure 2:
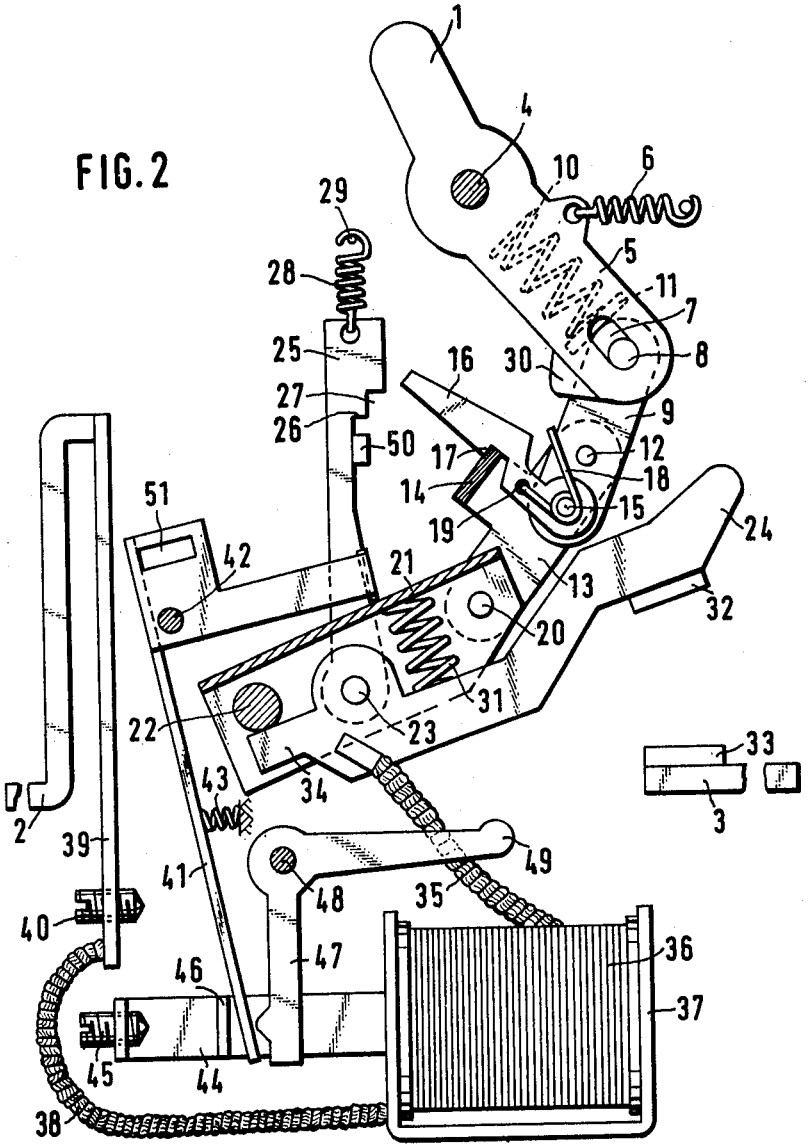
Figure 3:
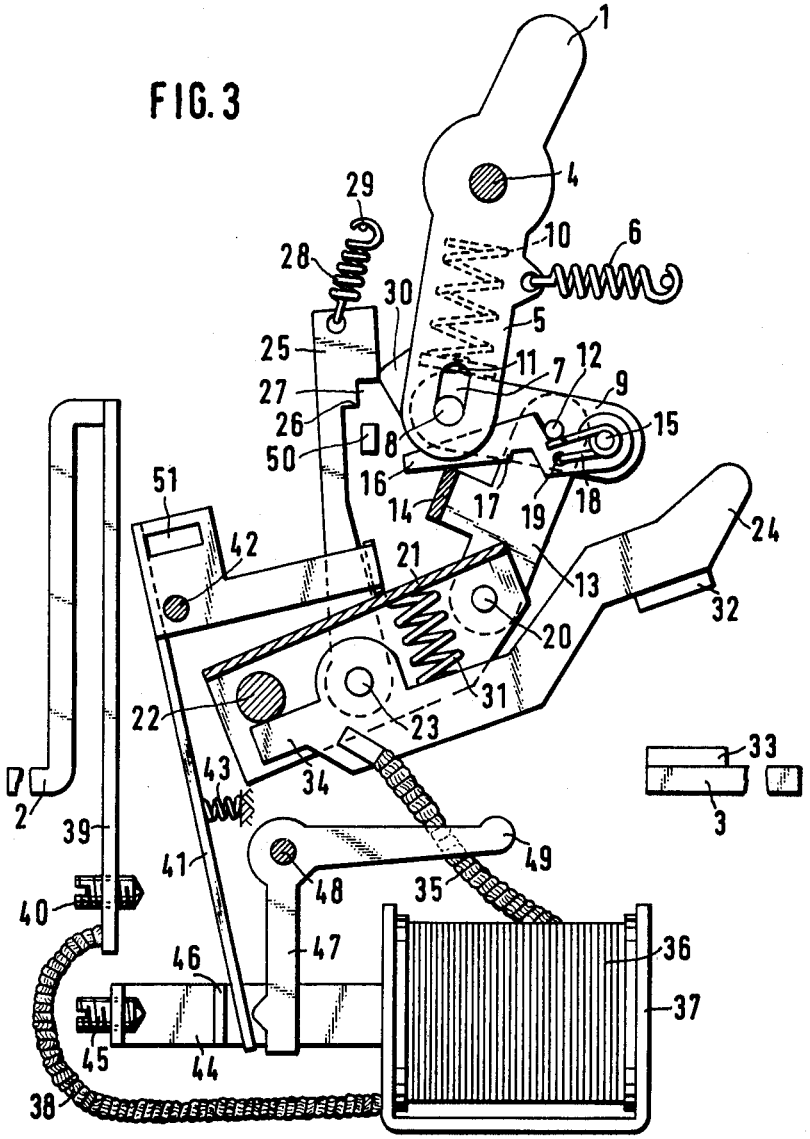
Figure 4:
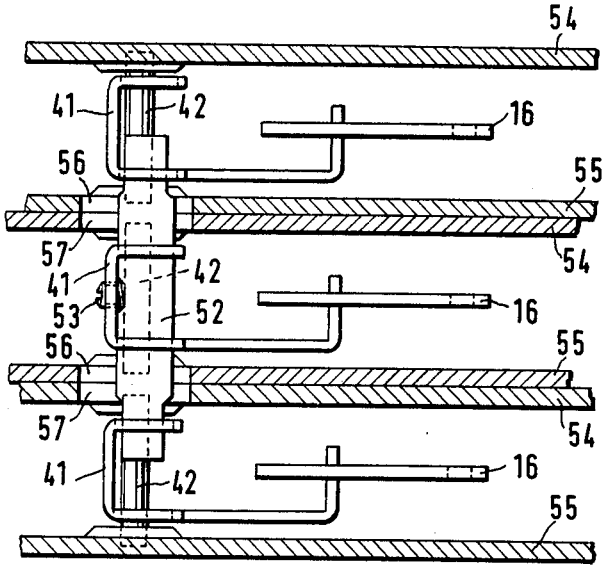

An illustrative embodiment of the invention will now be described, by way of example, with reference to the accompanying drawings, wherein:

FIG. 1 shows a side view of a single-pole excess current circuit breaker of the multi-pole excess current circuit breaker in accordance with the invention, in the on-position, FIG. 2 shows the same side view of the single-pole excess current circuit breaker as in FIG. 1 in the off-position after manual tripping, FIG. 3 shows the same side view of the single-pole excess current circuit breaker as in FIG. 1 in the off-position after a trip-free release, and FIG. 4 shows a section along the line IV—IV of FIG. 1 with certain parts omitted for the sake of clarity.

The multi-pole excess current circuit breaker shown in the drawings has three individual single-pole excess current circuit breakers, each of which is accommodated in a corresponding casing. An actuating element 1, in the shape of a lever with two arms, and two connection lugs 2 and 3 protrude from the casing. The actuating element 1 is supported in the casing, pivoting on a shaft 4. A tension spring 6 acts on an arm 5, disposed within the casing, of the actuating element. The arm 5 has a slot 7, with which a shaft 8 of a lever 9 engages. A spring 10 which is supported on a spring plate 11 which is in contact with the upper end of the lever 9 is located inside the arm 5. The lever 9 is hinged to a lever 13 by means of a pivot pin 12. The two levers 9 and 13 form a toggle. The lever 13 consists of a piece of sheetmetal, which is bent in the shape of a U: only the rear arm thereof is visible and the cross-piece 14 thereof is shown in section. The lever 9 extends beyond the pivot pin 12 and is hinged in this region by means of a pivot pin 15 to a locking lever 16 which engages with the cross-piece 14 by a retaining lug 17. In the on-position shown in FIG. 1, the locking lever 16 locks the two levers 9 and 13 of the toggle in an almost straight position so that they form, in this locked position, a rigid structure. The locking lever 16 is retained in its locked position shown in FIG. 1 by a spring 18 which sits on the pivot pin 15 and has the form of a torsion spring; one arm of this spring is supported on the lever 9 and the other arm is supported in a bore 19 in the locking lever 16. In this locked position, this rigid toggle forms, with the arm 5 of the actuating element 1, a toggle linkage.

The lever 13 is hinged, by means of a bolt 20 to a contact support 21 which is supported in the casing, pivoting on a shaft 22. The contact support 21 which is bent from a piece of sheetmetal in the shape of a U has a bolt 23 passing therethrough on which is supported on contact arm 24 pivoting in the contact support 21. A retaining latch 25 having a retaining lug 26 and an angled recess 27 is also hinged to the contact support 21 by means of the same bolt 23. A spring 28 in the form of a tension spring, the upper end of which is fastened to a bolt 29 located in the casing, holds the upper end of the retaining latch 25. The upper end of the retaining latch 25 interacts with a projection 30 on the arm 5 of the actuating element 1. A spring 31, one end of which is supported on the contact arm 24 and the other end of which is supported on the crosspiece of the contact support 21, is situated inside the contact support 21. Under the action of this spring 31, a contact piece 32 of the contact arm 24 is, according to FIG. 1, in contact with a stationary contact piece 33 of the connection lug 3, that is to say the spring 31 provides the contact pressure. The contact arm 24 has a projection 34, by means of which the contact arm 24, when in the open position according to FIGS. 2 and 3, abuts the shaft 22 under the action of the spring 31.

The contact arm 24 is connected, by means of a braided wire 35, to one end of the coil 36 of an electromagnet 37, the other end of the coil being connected, via a braided wire 38, to a bimetallic strip 39 which is fastened to the connection lug 2. The bimetallic strip 39 has an adjustment screw 40 which can act on an angular further lever 41 when the bimetallic strip 39 is deflected. The lever 41 is pivotally supported by a shaft 42 fitted in the casing. A compression spring 43 acts on the lower arm of the lever 41. By its upper arm, it can pivot the locking lever 16 into its inactive position. On the other hand, the contact support 21 can act on this upper arm of the lever 41.

The elctromagnet 37 has an armature 44 which is provided, at its left-hand end, with an adjustment screw 45 which acts on the lower arm of the lever 41 when the armature 44 is attracted by the excited electromagnet 37.

The armature 44 of the electromagnet 37 also has a stop 46 which can interact with an angular lever 47 which is supported in the casing, pivoting on a pivot pin 48. When the lever 47 is pivoted counter-clockwise in this way, the end 49 of the lever 47 strikes the contact arm 24 and, with a jerk, lifts its contact piece 32 off the stationary contact piece 33. In this way, opening of the contact is accelerated and, particularly in the case of a short circuit, a current-limiting effect is obtained.

As can be seen particularly from FIG. 4, each lever 41 has a U-shape. FIGS. 1 to 3 show that the arms of the U have rectangular recesses 51 in order to receive a coupling member 52. The lever 41 of the middle single-pole excess current circuit breaker is rigidly fixed to the coupling member 52 by means of a forcing screw 53. The coupling member 52 consists of insulating material and its cross-section has substantially the same rectangular shape as the rectangular recess 51. As FIG. 4 shows, both ends of the coupling member 52 are offset in such a way that these ends engage, leaving a clearance, with the corresponding rectangular recesses 51 in the two levers 41 of the outer single-pole excess current circuit breakers. The individual shafts 42 of the three excess current circuit breakers are held in mutual alignment by the coupling member 52. Each casing of the three single-pole excess current circuit breakers consists of two casing halves 54 and 55 which are joined together in the customary manner. Furthermore, the individual casings of the three single-pole excess current circuit breakers are rigidly connected to one another. In the region of the coupling member 52, the two casing halves 54 and 55 have recesses 56 and 57. The ends of the two outer shafts 42 are pivoted in corresponding recesses in the two casing halves 54 and 55.

In the on-position according to FIG. 1, current flows in the single-pole excess current circuit breakers shown from the connection lug 2 through the bimetallic strip 39, the braided wire 38, the coil 36, the braided wire 35, the contact arm 24 and through the contact pieces 32 and 33 to the connection lug 3. When an excess current occurs in this single-pole excess current circuit breaker, the bimetallic strip 39 is deflected counter-clockwise, its adjustment screw 40 acting on the lower arm of the lever 41 and pivoting the latter counter-clockwise so that its upper arm pivots the locking lever 16 clockwise into its inactive position in which its retaining lug 17 no longer engages with the crosspiece 14. The toggle consisting of the two levers 9 and 13 folds in under the action of the spring 31, and especially of the spring 28, and as a result the movable contact piece 32 is lifted off the stationary contact piece 33 and the circuit is thus interrupted. The same effect is obtained if, in the case of an electromagnetic trip, the adjustment screw 45 of the armature 44 acts on the lower arm of the lever 41. In the case of a short circuit, the angled lever 47 is actuated by the stop 46 on the armature 44 and extremely rapidly pivots the contact arm 24 counter-clockwise so that the movable contact piece 32 thereof is lifted off the stationary contact piece 33. In so doing the armature 44 acts on the lower end of the lever 41 causing it to turn counter-clockwise and pivoting the locking lever 16 clockwise.

As soon as, during this trip, the spring 28 under tension pivots the contact support 21, counter-clockwise according to FIG. 1, via the retaining latch 25, the contact support 21 entrains the upper arm of the lever 41 and pivots the latter counter-clockwise so that the corresponding levers of the two remaining single-pole excess current circuit breakers are taken along by the coupling piece 52. These levers 41 pivot the corresponding locking levers 16 into their inactive positions, as a result of which the tripping of these two other single-pole excess current circuit breakers also is initiated.

If the actuating element 1 is firmly held in its on-position according to FIG. 1, a trip-free release then takes place, according to which the single-pole excess current circuit breaker assumes the position shown in FIG. 3. If the actuating element 1 is freely movable, it is, already during the trip pivoted counter-clockwise into the off-position by means of the tension spring 6. The single-pole excess current circuit breaker then assumes the position shown in FIG. 2, in which the toggle consisting of the two levers 9 and 13 is locked in its almost straight position by the locking lever 16.

The outer ends of all the actuating elements 1 of the three single-pole circuit breakers are rigidly joined to one another by two cross-pieces. If the system is now switched on, from the position of the three-pole excess current circuit breaker according to FIG. 2, it being necessary for the actuating elements 1 to be pivoted clockwise according to FIG. 2, the contact support 21 and hence also the contact arm 24 are pivoted clockwise around the shaft 22 by the toggle which is almost straight and locked by the locking lever 16. Concurrently, the retaining latch 25 is taken along by the contact support 21 and moved downwards according to FIG. 2, the spring 28 being tensioned. This movement continues until the retaining lug 26 of the retaining latch 25 strikes the stop 50 fixed to the casing. At this time, the movable contact piece 32 of the contact arm 24 is slightly above the stationary contact piece 33, that is to say not yet in the on-position. The retaining lug 26 of the retaining latch 25 already strikes the stop 50 fixed to the casing before the toggle, which is formed by the arm 5, facing the casing, of the actuating element 1 and the toggle which is almost straight and locked by the locking lever 16, has reached its dead centre position. Until the toggle has reached the dead centre position, the spring 10 is compressed, and hence tensioned, by the axis 8 of the lever 9. During this compression, the shaft 8 moves in the slot 7 of the arm 5 in the direction towards the shaft 4 of the actuating element 1. After passing the dead centre, the projection 30 of the arm 5 of the actuating element 1 strikes the upper end of the retaining latch 25 and pivots the latter counter-clockwise until the retaining lug 26 thereof disengages from the stop 50 fixed to the casing and subsequently assumes the position shown in FIG. 1. Under the action of the strong spring 10 under tension, the contact support 21 is now pivoted clockwise around its shaft 22 by the almost straight and locked toggle and the contact arm 24 with its movable contact piece 32 is hence contacted with a jerk with the stationary contact piece 33 so that the system is switched-on instantaneously.

I claim:

1. In a multi-pole excess current circuit breaker assembly including a plurality of single-pole excess current circuit breakers each having relatively movable electric contacts having open and closed positions; an excess current responsive means; a pivotally supported release lever having first, second and third angular positions and being operatively connected to the excess current responsive means; the excess current responsive means being arranged to move the release lever from its first position to its second position upon sensing an excess current; a spring-loaded tripping mechanism operatively connected to one of the electric contacts and to the release lever; a locking device operatively connected to the release lever and the tripping mechanism; the locking device having a locking position in which it maintains the tripping mechanism locked and the electric contacts closed; the locking device having an unlocking position into which it is moved by the release lever upon motion of the release lever from its first position to its second position; in the unlocking position the locking device causing the spring-loaded tripping mechanism to open the electric contacts and to move the release lever from the second position to the third position; the circuit breaker assembly further including coupling means interconnecting the release levers of all the single-pole circuit breakers with one another for effecting motion of the release levers by any one release lever solely upon its motion from the second position to the third position effected by the spring-loaded trigger mechanism; the improvement wherein said coupling means comprises (a) a sole one-piece coupling member cooperating with the release levers of all of said single-pole circuit breakers;

(b) first securing means for rigidly affixing said one-piece coupling member to the release lever of one of said single-pole circuit breakers; and (c) second securing means for connecting said one-piece coupling member with the release lever of all the other of said single-pole circuit breakers with a clearance for effecting a pivotal motion of all the release levers solely when the release lever of any one of said single-pole circuit breakers is moved from said second position to said third position by the associated spring-loaded tripping mechanism.

2. A multi-pole excess current circuit breaker assembly as defined in claim 1, wherein said release levers have a common pivotal axis and said single-piece coupling member has a length dimension extending parallel to said common pivotal axis.

3. A multi-pole excess current circuit breaker assembly as defined in claim 1, wherein said one-piece coupling member has a rectangular cross section and wherein each release lever has a rectangular opening through which said one-piece coupling member passes; said second securing means comprising the positioning of said one-piece coupling member with a clearance in said opening of the respective release levers for providing a free relative angular motion of limited magnitude between said single-piece coupling member and the respective release lever.

4. A multi-pole excess current circuit breaker assembly as defined in claim 3, wherein said single-piece coupling member has an offset portion constituting that part that passes through said openings of the release levers with said clearance.

5. A multi-pole excess current circuit breaker assembly as defined in claim 4, wherein said first securing means comprises a tightening screw clamping the release lever of said one of said single-pole circuit breakers to said single-piece coupling member adjacent the offset portion thereof.

* * * * *